US010688362B1

(12) United States Patent
Sangalang

(10) Patent No.: US 10,688,362 B1
(45) Date of Patent: Jun. 23, 2020

(54) BASKETBALL SHOT PRACTICE STATION WITH COURT PROJECTION MAPPING

(71) Applicant: Gabriel Joshua Sangalang, Gotha, FL (US)

(72) Inventor: Gabriel Joshua Sangalang, Gotha, FL (US)

( * ) Notice: Subject to any disclaimer, the term of this patent is extended or adjusted under 35 U.S.C. 154(b) by 0 days.

(21) Appl. No.: 16/696,562

(22) Filed: Nov. 26, 2019

Related U.S. Application Data

(60) Provisional application No. 62/839,825, filed on Apr. 29, 2019.

(51) Int. Cl.
*A63B 69/00* (2006.01)
*A63B 71/06* (2006.01)
*A63B 24/00* (2006.01)

(52) U.S. Cl.
CPC ..... *A63B 69/0071* (2013.01); *A63B 24/0062* (2013.01); *A63B 71/0622* (2013.01); *A63B 2024/0034* (2013.01); *A63B 2071/0694* (2013.01); *A63B 2220/806* (2013.01); *A63B 2225/093* (2013.01); *A63B 2225/096* (2013.01); *A63B 2230/015* (2013.01)

(58) Field of Classification Search
CPC ..... A63B 24/0062; A63B 2024/0034; A63B 2071/0694; A63B 2220/806; A63B 2225/093; A63B 2230/015
USPC ..... 473/447
See application file for complete search history.

(56) References Cited

U.S. PATENT DOCUMENTS

| | | | | |
|---|---|---|---|---|
| 3,572,703 | A | 3/1971 | Greene | |
| 4,545,576 | A | 10/1985 | Harris | |
| 5,035,423 | A * | 7/1991 | Arciniega | A63B 63/083 273/406 |
| 5,364,091 | A | 11/1994 | Sebek | |
| 5,967,892 | A | 10/1999 | Shoemaker, Jr. | |
| 6,283,475 | B1 | 9/2001 | Stubben | |
| 6,918,591 | B2 | 7/2005 | D'Amico et al. | |
| 7,736,248 | B2 | 6/2010 | Eldridge | |
| 8,052,544 | B2 | 11/2011 | Tien | |
| 9,539,496 | B1 | 1/2017 | Shoemaker, Jr. | |
| 2008/0312010 | A1 * | 12/2008 | Marty | A63B 24/0003 473/447 |

(Continued)

FOREIGN PATENT DOCUMENTS

WO WO0141884 A1 6/2001

*Primary Examiner* — John E Simms, Jr.
*Assistant Examiner* — Rayshun K Peng
(74) *Attorney, Agent, or Firm* — John V Stewart

(57) ABSTRACT

A basketball shot practice station with movable positioning of the backboard and basket relative to a stationary shooting position of a user. A projection-mapped court image is projected on the floor of the station from the viewpoint of the user based on the basket position. Cameras image the shooter and the ball flight. A control system analyzes the shooter's technique and ball trajectory, categorizes the shot results, and automatically adjusts the basket position to produce a given success rate by the user. It stores a profile of each user, and updates the user's shooting statistics and skill level based on the shot results of each session. It initializes the profile with a default skill level based on initial input data. It may estimate a user's age, height, and strength based on their image and weight. It increases the shot distance and backboard angles with increasing skill level.

15 Claims, 2 Drawing Sheets

(56) References Cited

U.S. PATENT DOCUMENTS

| | | | | |
|---|---|---|---|---|
| 2009/0137347 | A1 | 5/2009 | Jenkins et al. | |
| 2016/0082340 | A1 | 3/2016 | Adams | |
| 2018/0056124 | A1* | 3/2018 | Marty | A63B 24/0021 |
| 2019/0299057 | A1* | 10/2019 | Vollbrecht | G06T 7/246 |

* cited by examiner 15
11
9
9
5
28
3
24
17
6
30
29
9
11
12
13
9
10
4
33
7
P3
18B
8
P8
34
14
P4
18

BASKETBALL SHOT PRACTICE STATION WITH COURT PROJECTION MAPPING

FIELD OF THE INVENTION

The invention relates to a physical basketball shot practice station with adjustable positioning of the backboard and basket relative to a stationary shooting position of a user, with projection of a court image from the viewpoint of the user coordinated with the basket position, analysis of the shooter's technique, and automatic adjustment of the basket position to produce a given shot success rate.

BACKGROUND

Basketball shooting skill is greatly improved with coaching and practice. Individual coaching and analysis are expensive, but practice without coaching is less effective and can perpetuate poor techniques. One can be discouraged by a low shot success rate. Some people including young children find it hard to project the ball to the basket. Players of all levels may be bored by lack of variety and feedback and a low improvement rate.

Practice aids include rebounders that return each ball from a standard basket. Dedicated practice stations with movable baskets and rebounding systems allow more shots to be made in a given time to different basket positions from a stationary shooting position.

SUMMARY OF THE INVENTION

An objective of the invention is to provide a basketball shot practice station with a stationary shooting position and a basket that is movable in distance and angle relative to the shooting position to simulate shots from anywhere on a basketball court up to a 3-point range. Another objective is to provide a projection map of a basketball court as seen from the viewpoint of the shooter coordinated with the changing basket position to present an immersive realistic experience. Other objectives include:

- Shooter will shoot a physical basketball from a stationary position into a physical basketball hoop in an environment of augmented reality and mixed reality that is fully immersive to simulate real-game scenarios.
- Dynamic projection mapping of court imagery onto the floors and walls will coordinate with the physical position of the backboard/rim height, distance and angulation to simulate any shooting position at and inside the standard 3-point line. Optionally, the practice station court and projections may be made large enough to simulate shooting half court or full court shots.
- A computerized control system will analyze shots via video cameras, and automatically position the rim so the shooter can successfully make most of the shot attempts to the basket.
- Cameras and weight sensors allow the control system to calibrate an automated practice sequence for each shooter considering factors such as height, age, and gender of the shooter
- Data inputs from the basket positioner allow the control system to determine the position of the hoop, and generate a respective and complimentary video/image/animation projection map on surfaces of the station juxtaposed with the real basket from the shooter's viewpoint.
- Sensors collect data input for shot attempts that are made or missed from all simulated positions.

- Each shot will be classified as either
  - a) a swish, when the ball goes through the basket without touching anything else;
  - b) a bank, when the ball bounces off the backboard and goes through the basket;
  - c) a rattle, when the ball bounces off the rim and goes through the basket; or
  - d) a miss.
- Every individual will have a unique "profile" in which all data throughout their experiences will be tracked and recorded, such as "field goal percentage".
- A skill level of each individual will be initially estimated by prior market research. The skill level will determine a default starting position of height, distance and angle of the basket/backboard.
- The skill level will be adjusted dynamically based on the success rate within a given number of shots, such as a running average of the last 10 shots. When a target success rate is missed or exceeded, the control system changes the basket position to reduce or increase difficulty. Such changes may be determined or refined by machine learning, including supervised learning and reinforcement learning.
- Individualized automated analysis and guidance.

DRAWINGS

The invention is explained in the following description in view of the drawings that show:

DETAILED DESCRIPTION

Figure 1:
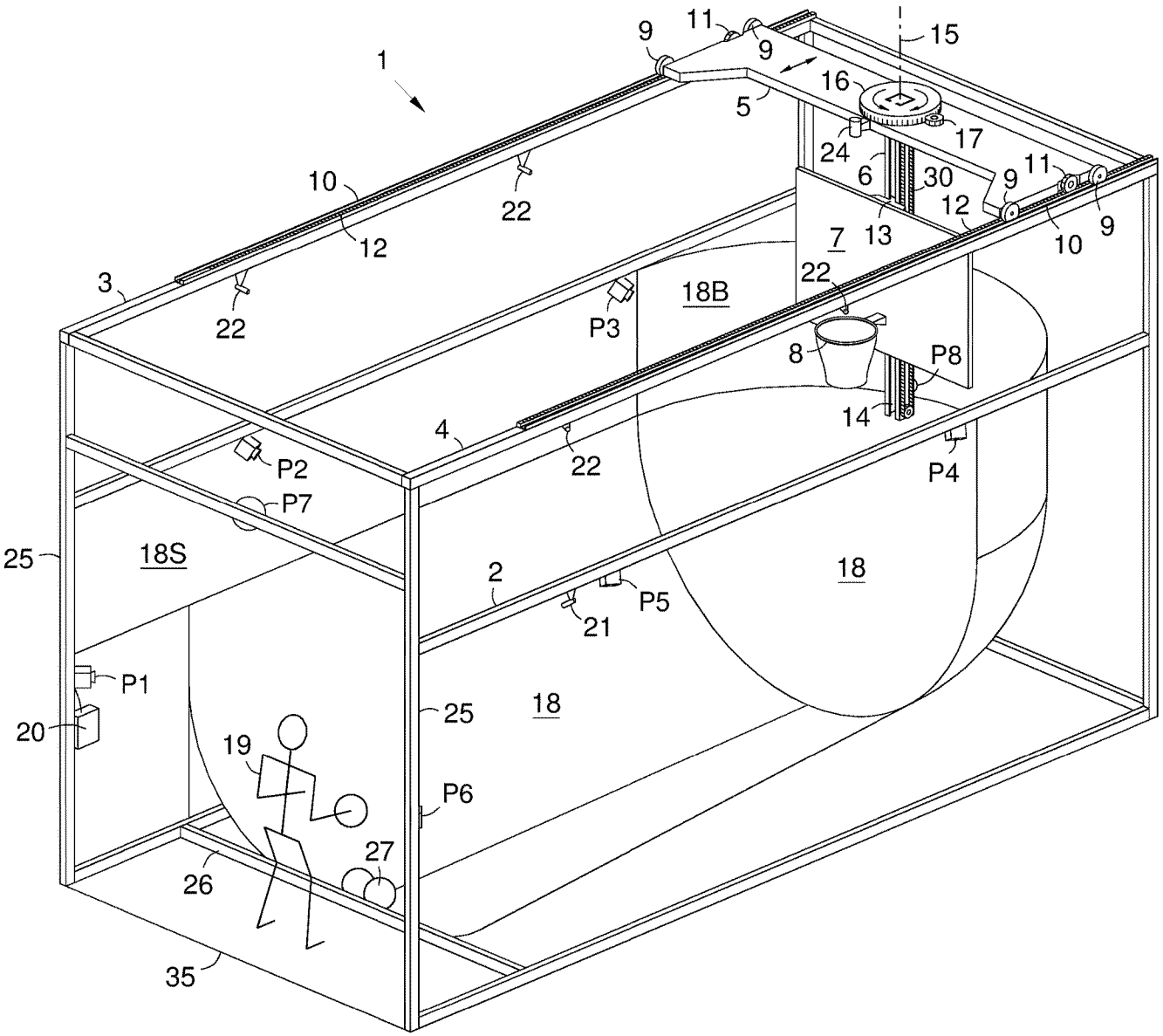
FIG. 1 is a perspective view of a structure showing aspects of the invention.

FIG. 1 shows a structure 1 illustrating aspects of the invention, including a frame 2 with upper left and right side beams 3, 4 that support a movable carriage 5 that supports a vertical mast 6 that supports a backboard 7 that supports a basketball hoop 8. Alternately, the upper side beams 3, 4 may be supported on side walls of a room built for example like a squash court. The movable carriage 5 may roll along the upper side beams 3, 4 by wheels 9 set on tracks 10. The tracks are shown as upright U-channels for clarity. They may alternately be inverted or lateral C-channels with the wheels inside. A drive mechanism is provided that moves the carriage 5 along the tracks 10. For example, a pinion gear 11 engages a linear gear rack 12 beside each track 10. Alternate drive means include, without limitation, a translation screw or a chain drive along each track.

The backboard 7 may be mounted on a backplate 13 that slides or rolls in a vertical channel 14 of the mast 6. The vertical position of the backboard is controlled by a lift chain 30 as on a fork lift. A motor with a chain drive sprocket (not visible in this view) may be mounted to the underside of the carriage 5. Alternate lift mechanisms include, without limitation, pulleys and belts, a translation screw, or a rack and pinion.

The backboard also rotates about a vertical axis 15. For clarity this is shown by the mast being attached to a rotation plate 16 mounted on the carriage 5 on bearings. A drive gear 17 engages the rotation plate. The drive gear is driven by a motor (not shown) on the carriage 5.

A floor surface 18 has a shape that funnels the ball back to the shooter 19. It may be concave upward and forward and sloped downward toward the shooter to return balls 27. It is reflective as a display screen on which one or more projectors P1-P8 display a basketball court from the shooter's viewpoint by projection mapping. Multiple digital projectors may be coordinated by a computerized control system 20 to cover respectively different areas of the surface. Alternately, a single projection device P7 may cover the whole surface via one or more lenses. A supplemental projector P8 may be provided on the back of the mast or backboard to cover a back part of the floor surface 18 that is shaded by the backboard from coverage by the other projectors.

The floor surface 18 may smoothly join the side walls 18S and back wall 18B, which may extend high enough, so the projection map can include images of walls of a full-sized basketball facility, and may further include images of bleachers and spectators. The eye position of the shooter must be known to the control system to calculate the projection geometry. This can be provided by one or more cameras 21 aimed at the shooter and/or by input of the shooter's height. These cameras may also be used by the control system to automatically analyze each shooter's technique.

The standing position of the shooter 19 may be closer to the basket than the vertical front beams 25 of the frame 2, so that these beams and attached devices do not enter the shooter's field of view. The intention is to immerse the shooter in the perceived reality of the projection map of the court. A front floor beam 26 or other barrier may be about four feet closer to the basket than the front vertical side beams 25. This barrier prevents the shooter from stepping onto the surface 18. This floor beam 26 can also catch the returned balls 27. Optionally, a ball lifting device (not shown) may be provided so the shooter does not need to bend over to retrieve the balls.

The surface 18 should be long enough to allow shooting from the US National Basketball Association (NBA) 3-point distance. This means the front edge of the floor surface 18 and the front floor beam 26 should be at least 23.75 feet forward of the center of the hoop 8 at its maximum distance from the shooter. The top beams 3, 4 should be high enough to provide a 10-foot-high hoop position via the carriage 5 and mast 6, and also high enough that the carriage 5 does not interfere with shots. The ball trajectory can go above the top beams 3, 4 for high shots. If the structure 1 is enclosed in a room with a ceiling, the ceiling height should be at least 16 feet, and preferably at least 20 feet above the floor level. For clarity, FIG. 1 is shorter than scale in the length dimension. It is shortened by about 25%.

The position of the backboard may be controlled by an input device connected to the control system 20, for example a joystick. An automatic practice mode may be provided by the control system 20 based on shooter's age, height, and skill level. For example, the backboard may be moved closer and lower for short people and beginners. Cameras 22, 24 provide ball flight imagery for the control system to analyze the shooting technique and success rate. A running success rate goal over the last N shots, for example 10-20 shots with 80% success may be used for encouragement and progress. The shooter may enter a success rate goal into the control system, preferably in the range of 75-85%. The backboard/hoop can move close enough to achieve this success rate, then move farther when the success rate goal is exceeded for a given number of consecutive shots such as 10-20. The control system creates and retains a unique profile for each shooter that tracks details of his/her shooting statistics and skill level, and may include the following data:

Success rate at each backboard position

Type of baskets made at each position (swish, rattle, and bank shots)

Success rate by ball trajectory (higher vs lower)

Shooting technique (arm and body position and motion)

The control system 20 may include one or more processors with image processing logic that analyzes images from the ball trajectory cameras, identifies the ball and its trajectory, and determines whether and how the ball passes through the hoop. If it passes through the hoop without contact with the rim or backboard it is a "swish". If it contacts the only the rim, it is a "rattle". If it contacts the backboard, it is a bank shot. The logic may be algorithmic and/or may use machine learning and artificial neural networking.

Each shooter may be identified in the control system by personal data including name, birthdate, and optionally biometric data. A shooter standing platform 35 may be provided with a weight sensor that weighs each shooter. The control system may include a fingerprint reader, palm print reader, or phone barcode reader for quick sign-on. The control system may track a user's weight and height over time, and adjust their skill level upward as they outgrow childhood and adolescence.

Figure 2:
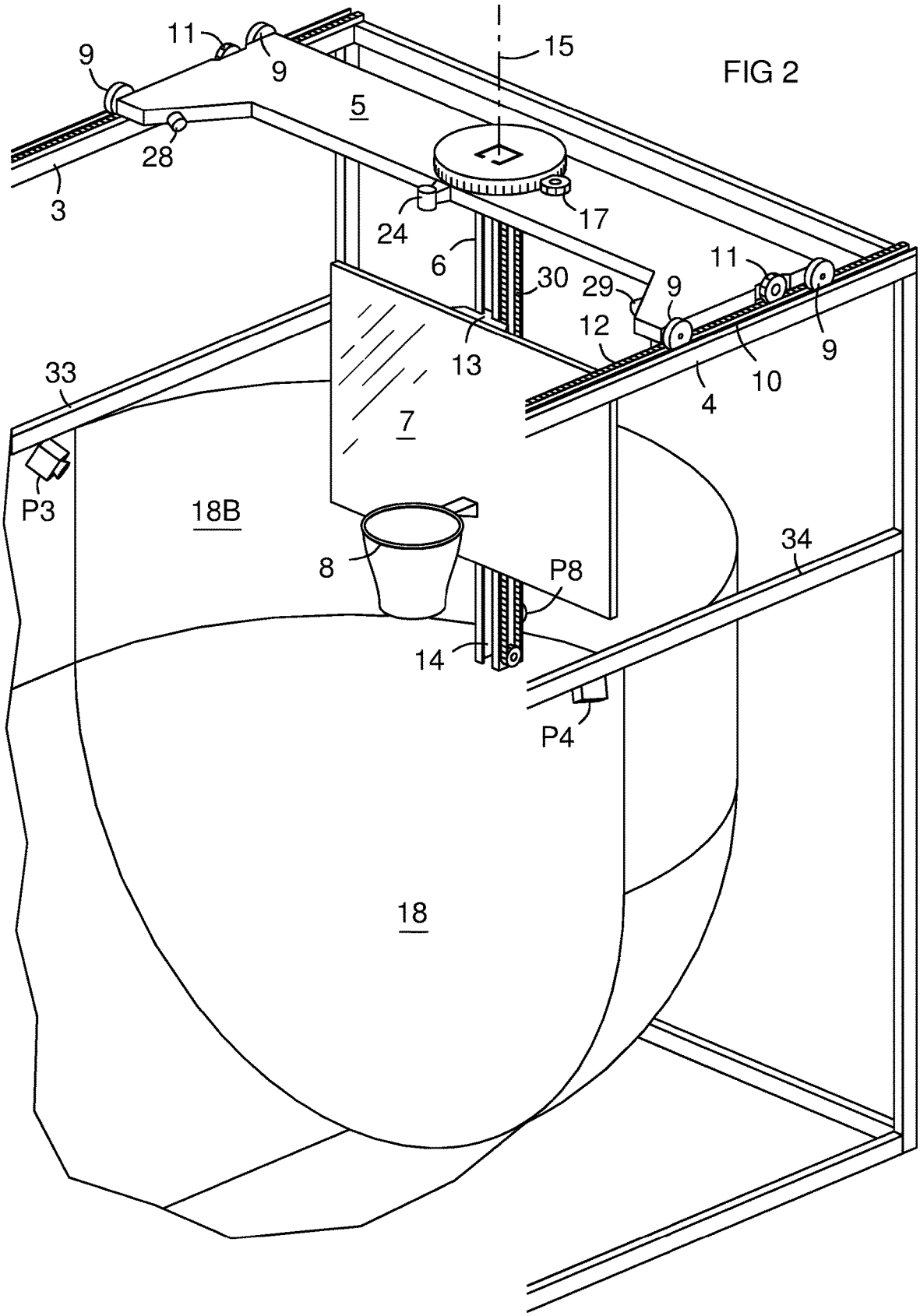
FIG. 2 shows an enlarged back portion of FIG. 1.

FIG. 2 shows a mobile camera 28 mounted on the left end of the carriage 5 aimed toward the left side of the hoop 8. Another mobile camera 29 is mounted on the right end of the carriage 5 aimed toward the right side of the hoop 8. These cameras have a stereo view of the hoop for 3D modeling of the ball trajectory near the hoop. When the backboard is turned, it blocks one of the cameras 28, 29. However, the top camera 24 and at least one of the side cameras 28, 29 are always in view of the hoop. Thus at least 2 cameras have different view angles of the hoop at all times, providing stereo vision that supports 3D modeling of the ball flight in any position of the backboard. Alternately or additionally, multiple cameras may be mounted along the side beams 3 and 4, and/or side beams 33 and 34 and/or other places to provide at least two clear stereo viewpoints to the hoop at all times. The ball flight can be tracked and its 3D trajectory modeled in real time as is done with Hawk-Eye technology for tennis and other sports. This type of technology is described in International patent application publication WO0141884A1 and in U.S. Pat. No. 4,545,576. Alternately, or additionally, other technologies may be used, such as RFID chips in the basketball responding to RFID readers in the side beams, doppler radar, and/or contact sensors in the backboard and rim.

The position of the floor 18 and wall surfaces 18S, 18B are fixed, so a predetermined 3D model of these surfaces can be stored in the control system for the projection mapping surface geometry and focus. Optionally, the projectors P2-P5 can project image calibration patterns on the reflective surfaces 18, 18S, 18B, and the cameras 22, 24, 28, 29 can use autofocus technology to map the surfaces before first use or before or during each use. The backboard/basket position can be dynamically modeled in the control system by the basket positioning outputs, or position sensor inputs, or image analysis from cameras 22, 24, 28, 29.

If the ball bounces off the rim or backboard, its trajectory has a sharp change of direction that can be tracked by the software to categorize the shot as a rattle or bank shot. It the trajectory reverses direction outside the hoop and goes through the hoop, it is a bank shot. If the trajectory reverses direction at the hoop and goes through the hoop, it is a rattle shot.

The control system 20 may be hardwired to positioning motors and position sensors on the carriage 5 and mast 6 or it may connect to them wirelessly. It may be hardwired to the projectors P1-P8 and cameras 21, 22, 24, 28, 29 or it may connect to them wirelessly. The control system may analyze the camera data and the shooter profile to make recommendations based on expert shooting techniques. Selected training videos can be projected onto the surface 18 acting as a video screen. The system can act as a personal trainer.

Operation of the basketball shot practice station may comprise the following steps:

a) a shooter or an operator inputs profile data of the shooter into the control system;

b) the control system creates and retains a profile from the data of the shooter;

c) the shooter stands at the shooting position;

d) the control system estimates an initial skill level of the shooter based on the profile or by analyzing images of the shooter from one or more cameras 21 on the station;

e) the control system initially positions the basket at a height and proximity to the shooter to achieve a given shot success rate based on the initial skill level;

f) the control system determines an eye position of the shooter from the input data or from images of the shooter, uses the eye position to compute a projection map of a basketball court from the viewpoint of the shooter, and outputs the projection map to one or more projectors on the station;

g) the control system analyzes images of each shot from cameras 22, 24, 28, 29 on the station, determines whether the shot passes through the basket, compiles shot success statistics, and saves the statistics in the shooter profile;

h) the control system dynamically updates the skill level based on the success rate over a given number of consecutive shots of the shooter, and automatically adjusts the position of the basket to achieve a given running success rate over the next given number of consecutive shots;

i) The control system dynamically updates the projection map in coordination with adjusting the position of the basket.

When the shooter returns for a subsequent session, the shooter's profile is retrieved in the control system, and the shooter starts where they left off in the previous session. The control system can use an individual's imaged shooting technique combined with their success with each technique to determine their most successful shooting technique based on posture, body motion, and ball trajectory. A swish may be given a higher success rating than a rattle or bank.

The practice shot station herein may be used in conjunction with a human coach or an automated coach. A human interface may be provided by a touch screen connected to the control system. Statistics compiled by the control system may be shown on the touch screen. A shooter or coach may interact with the control system via the attached touch screen or via a personal mobile electronic device, including a smart phone or tablet via a wireless connection including for example Wi-Fi or Bluetooth. A software application in the control system and/or in the personal mobile electronic device may prompt the shooter or coach, allow them to control the basket position, display statistics, input personal information and skill level changes, and select an automated sequence of basket positions from among a stored set of practice sequences that may be created and customized by the user.

While various embodiments of the present invention have been shown and described herein, such embodiments are provided by way of example only. Changes and substitutions may be made without departing from the invention herein. Accordingly, the invention is to be limited only by the scope and intended meaning of the appended claims.

The invention claimed is:

1. A basketball shot practice station comprising:

a standing position for a human shooter of a physical basketball;

a physical basketball basket on a positioning apparatus that varies a position of the basket in height, distance, and angle of the basket relative to the shooter;

a computerized control system that controls the positioning apparatus;

a floor surface between the shooter and the basket; and one or more projectors that project an image of a basketball court onto the floor surface as a projection map that is dynamically coordinated with the position of the basket to present an appearance of a physical basketball court from the viewpoint of the shooter;

wherein the floor surface blends smoothly into left, right, and back wall surfaces that serve as a projection screen for the image of the basketball court.

2. The basketball shot practice station of claim 1, wherein a back of the floor surface is concave upward and forward, and a bottom of the floor surface is concave upward and sloped downward from back to front to return balls to the shooter.

3. The basketball shot practice station of claim 2 further comprising:

a frame comprising upper left and right horizontal side beams having front and back ends, lower left and right horizontal side beams comprising front and back ends, a left front vertical beam between the front ends of the left upper and lower horizontal side beams, a right front vertical beam between the front ends of the right upper and lower horizontal beams;

a carriage mounted to and between the upper left and right side beams for forward and backward movement thereon via a first actuator connected to the control system;

a vertical mast mounted on the carriage for rotatable movement about a vertical axis via a second actuator connected to the control system;

a basketball backboard mounted on the vertical mast; and the basket mounted on the backboard;

wherein the standing position of the shooter is closer to the basket than the left and right front vertical beams.

4. The basketball shot practice station of claim 3 further comprising:

the backboard mounted to the vertical mast for vertical movement thereon, via a third actuator connected to the control system.

5. The basketball shot practice station of claim 4 further comprising:

a horizontal front floor beam between the shooting position and the basket that stops and retains basketballs returning forward on the floor surface.

6. A basketball shot practice station comprising;

a standing position for a human shooter of a physical basketball;

a physical basketball basket on a positioning apparatus that varies a position of the basket in height, distance, and angle of the basket relative to the shooter;

a computerized control system that controls the positioning apparatus;

a floor surface between the shooter and the basket;

one or more projectors that project an image of a basketball court onto the floor surface as a projection map that is dynamically coordinated with the position of the basket to present an appearance of a physical basketball court from the viewpoint of the shooter; and one or more ball flight sensing elements connected to the control system that input ball flight data to the controller;

wherein the control system determines from the ball flight data whether each shot passes through the basket, and compiles shot success statistics in a retained profile of the shooter;

wherein the control system initializes a skill level indication for the shooter, stores it in the profile, and thereafter updates the skill level indication based on the shot statistics; and wherein the control system dynamically updates the skill level indication based on a given number of consecutive shots of the shooter, and automatically adjusts the position of the basket to achieve a given running success rate for said shooter over a subsequent given number of consecutive shots.

7. The basketball shot practice station of claim 6, further comprising:

wherein the one or more ball flight sensing elements comprises cameras that capture at least two different view angles of the basket throughout all positions of the basket; and the control system models a 3-dimensional trajectory of each ball shot via the images from the cameras, and categorizes each shot as either a) a swish, wherein the ball goes through the basket without touching anything else;

b) a bank, wherein the ball bounces off the backboard and goes through the basket;

c) a rattle, wherein the ball bounces off the rim and goes through the basket; or d) a miss.

8. The basketball shot practice station of claim 7, wherein the control system maintains the success rate statistics for the shooter by categories of swish, bank, rattle, or miss, by basket position, and by shooting technique comprising trajectory height, and makes technique recommendations to the shooter based on the success rate statistics by shooting technique.

9. A basketball shot practice station comprising;

a standing position for a human shooter of a physical basketball;

a physical basketball basket on a positioning apparatus that varies a position of the basket in height, distance, and angle of the basket relative to the shooter;

a computerized control system that controls the positioning apparatus;

a floor surface between the shooter and the basket;

one or more projectors that project an image of a basketball court onto the floor surface as a projection map that is dynamically coordinated with the position of the basket to present an appearance of a physical basketball court from the viewpoint of the shooter;

a camera connected to the control system that inputs an image of the shooter to the control system;

wherein the control system determines from the image a height and eye position of the shooter, and uses the eye position to compute the projection map from the viewpoint of the shooter.

10. The basketball shot practice station of claim 9, wherein the control system further estimates an initial skill level of the shooter from the height of the shooter, and provides an initial basket position based on the initial skill level to achieve a given shot success rate for the shooter over a given number of consecutive shots.

11. The basketball shot practice station of claim 9, wherein the control system further estimates an initial skill level of the shooter from data entered into the control system by the shooter, and provides an initial basket position based on the initial skill level to achieve a given shot success rate for the shooter over a given number of consecutive shots.

12. A method of operating a basketball shot practice station, comprising the steps of:

providing a standing position for a human shooter of a physical basketball;

providing a physical basketball basket on a positioning apparatus that varies a position of the basket in height, distance, and angle relative to the shooter;

providing a computerized control system that controls the positioning apparatus;

providing one or more projectors that project an image of a basketball court onto the floor surface as a projection map that is dynamically coordinated with the position of the basket to present the appearance of a physical basketball court from the viewpoint of the shooter;

providing one or more ball flight sensing elements connected to the control system that input ball flight data to the controller;

the shooter or an operator inputting profile data of the shooter into the control system;

the control system creating and retaining a profile of the shooter from the profile data;

the shooter standing at the standing position;

providing one or more cameras connected to the control system that image the shooter;

the control system estimating an initial skill level of the shooter based on the profile or by analyzing images of the shooter from the one or more cameras;

the control system initially positioning the basket at a height and proximity to the shooter to achieve a given shot success rate based on the skill level;

the control system determining an eye position of the shooter from the image of the shooter, using the eye position to compute a projection map of a physical basketball court from the viewpoint of the shooter, and projecting the projection map onto the floor surface from one or more projectors on the station;

the control system analyzing the ball flight data, determining whether the shot passes through the basket, and compiling shot success statistics in the shooter profile;

the control system dynamically updating the skill level based on a given number of consecutive shots of the shooter, and automatically adjusting the position of the basket to achieve the given success rate over a given number of consecutive shots; and the control system dynamically updating the projection map in coordination with adjusting the position of the basket so the projected court appears realistic to the shooter in juxtaposition with the basket.

13. The basketball shot practice station of claim 12, wherein the control system maintains success rate statistics for each shooter by categories of swish, bank, rattle, or miss, by basket position, and by shooting technique comprising trajectory height.

14. The method of claim 12, further comprising the steps of:

providing a weight sensor in a platform comprising the standing position;

the control system measuring a weight of the shooter via the weight sensor;

the control system tracking a height of the shooter over time via the one or more cameras; and the control system adjusting the shooter's skill level based on physical growth of the shooter over time as the shooter ages.

15. The method of claim 12, further comprising using machine learning to automatically adjusting the position of the basket to achieve the given success rate over the given number of consecutive shots.

* * * * *